US008684059B2

(12) United States Patent
Broek

(10) Patent No.: US 8,684,059 B2
(45) Date of Patent: Apr. 1, 2014

(54) METHOD AND APPARATUS FOR TABBING MANUALLY-MANIPULATED FOLDED MATERIAL

(76) Inventor: Chris Vanden Broek, Ann Arbor, MI (US)

( * ) Notice: Subject to any disclaimer, the term of this patent is extended or adjusted under 35 U.S.C. 154(b) by 10 days.

(21) Appl. No.: 12/736,374

(22) PCT Filed: Apr. 2, 2008

(86) PCT No.: PCT/US2008/004360

§ 371 (c)(1),
(2), (4) Date: Oct. 1, 2010

(87) PCT Pub. No.: WO2009/123589

PCT Pub. Date: Oct. 8, 2009

(65) Prior Publication Data

US 2011/0024027 A1 Feb. 3, 2011

(51) Int. Cl.
*B29C 65/48* (2006.01)

(52) U.S. Cl.
USPC ..... 156/581; 156/516; 156/510

(58) Field of Classification Search
USPC ..... 156/468, 475, 204, 483, 484, 212, 516, 156/213, 517, 530, 522, 581, 580
See application file for complete search history.

(56) References Cited

U.S. PATENT DOCUMENTS

| | | | | |
|---|---|---|---|---|
| 5,730,827 | A * | 3/1998 | Sewell | 156/269 |
| 6,599,073 | B1 * | 7/2003 | Hartwig et al. | 412/8 |
| 2004/0038795 | A1 * | 2/2004 | Jaksch | 493/376 |

* cited by examiner

*Primary Examiner* — Katarzyna Wyrozebski Lee
*Assistant Examiner* — Vishal I Patel
(74) *Attorney, Agent, or Firm* — Rohm & Monsanto, PLC

(57) ABSTRACT

A method and apparatus for tabbing a piece of folded material includes a fixture into which a folded material is manually inserted and retracted. A dispensing device automatically dispenses a length of adhesive tape that may be pinked on at least one edge, and a cutting device separates the length of pinked tape from its source. A lower platen slides below the inserted media and traps a piece of the adhesive tape between the lower platen and the media. An upper roller or sliding member moves over the opposite side of the media for folding the remaining portion of the adhesive tape over the opposite side of the media and causing good contact between the adhesive surfaces of both portions of the folded adhesive tape and the media, thereby completing the sealing action. The media then is retracted manually.

4 Claims, 9 Drawing Sheets

METHOD AND APPARATUS FOR TABBING MANUALLY-MANIPULATED FOLDED MATERIAL

RELATIONSHIP TO OTHER APPLICATION(S)

This application is a US national stage filing under 35 U.S.C. §371 of International Application No. PCT/US2008/00 4360 filed on Apr. 2, 2008.

BACKGROUND OF THE INVENTION

Tabbers are devices that are used, typically, for sealing self-mailers. The term "self-mailer" is applied to one or more sheets of printed material folded at least once to make a convenient smaller piece for mailing without an envelope. Being folded, self-mailers are closed on one edge but must be sealed on the other edges in order to maintain a flat, closed state during mailing. A popular sealing device is the tabber, which applies a piece of adhesive tape in one or more places along the openable edges of the self-mailer.

There is a rich prior art and a variety of devices available on the market directed to sealing self-mailers. For example, U.S. Pat. No. 6,464,819 discloses a tabber that uses a continuous tape. U.S. Pat. No. 6,090,034 discloses a tabber that employs singulated tabs mounted on a backing tape. These devices and the art available serve the high-volume portion of the self-mailer market. More specifically, that portion of the market in which a few thousand or more pieces are to be tabbed and sent through the mail. Because of the emphasis on processing high volumes, this equipment employs more or less automatic handling of the media as well as automatic placement of the tab on the media. As a consequence, some adjustment to the equipment is necessary prior to use in order to correctly handle the different sizes and thickness of media. Also, automatic media handling favors designs wherein the media moves in a continuous fashion through an apparatus having an inlet and a separate exit so that actual time within the apparatus is minimized. Further, this equipment is relatively expensive and can be justified only when the equipment costs can be amortized over the thousands of self-mailers that are tabbed.

A common problem encountered in the use of tape to seal self mailers is that once sealed, the mailer is often damaged when an attempt is made to unseal it. The unsealing is typically effected by tearing the tape at the point where it is folded by inserting a finger between the leaves of the sealed material and running the finger along the length of the sealed edge. Hopefully, only the tape is torn and the sealed material may then be opened. A knife may be used, or one may also attempt to peel the tape away from the surface of the media. In the case where a finger or similar dull instrument is used, it is well known that the sealed media may give way before the tape is broken. Sometimes, the tape is not broken at all, rather the media is torn in the course of attempting to open it.

One solution to the media tearing problem is through the use of tabs or tape that have a line of perforations along the crease of the tab or tape fold. The perforations serve the purpose of making the tab or tape weaker along the crease so that when the sealed material is forced open, the tab or tape tears instead of the media. This solution has disadvantages in that the tabbing apparatus must allow for either a) orienting of the pre-perforated tab pieces so that the tab perforation line ends up as the crease of the tab orb) some mechanism within the tabbing apparatus perforates the tab at the crease as a part of application of the tab.

No teaching or prior art is available for the user who wishes to send out a small quantity of self-mailers, say from one to a thousand pieces, where the set-up and capital investment required of the high-volume tabber are unattractive. Such a user is now forced to purchase sets of tabs and apply them by hand, or use a common adhesive tape and apply the tape by hand to the self-mailer.

SUMMARY OF THE INVENTION

The present invention addresses the need for a device that has no set-up adjustments, and is less expensive than other available devices, but which makes the task of adding tabs by hand very easy because human handling is limited to moving the media, and no work is expended in manually moving, folding, and pressing the tab onto the media. To be ergonomically pleasing and simple to use, the apparatus is configured so that media is inserted and retracted from a fixture, much like a common office-type automatic stapler. This avoids a through-system commonly used by high-volume machines that require, when media is moved manually by one person, extra manipulation to insert media into a fixture entrance and extract it from a fixture exit in some different location. It is an object of the present invention to provide a small, easily portable, tabbing apparatus that will tab media, the media being manipulated by simple hand motions. The invention does not require any set up adjustments, and because of its small size, is inexpensive to purchase compared to devices described in the prior art. It is a further object of the invention to provide an apparatus that can make use of a pressure sensitive adhesive tape without a separable backing, thus avoiding the use and expense of separate tabs mounted on a backing material that is discarded. The invention avoids the employment and expense of the special registration means required by equipment that applies such separate tabs mounted on a backing material.

The present invention comprises an apparatus that will automatically tab a self-mailer when the self-mailer, or media, is manually inserted and retracted. Manual activity is restricted to moving the media. The present invention requires no set-up adjustments, but, rather, is configured to accept virtually any self-mailer of any planar size and any thickness offered by one or several folded pages up to some limit depending on the exact design, but presumably on the order of ⅛ inch. The flexibility in servicing these different configurations with no set-up becomes especially important for large media, which according to U.S. Postal regulations, must be sealed in several places. The present invention can make use of virtually any tabbing medium, including continuous or discrete pieces of pressure sensitive adhesive tape without backing and having a sticky surface on one side and a non-sticky surface on the other side, so long as the tape is presented to the portion of the apparatus that performs the application of the tape to the media. The embodiment described here makes use of a continuous tape that is dispensed according to the teachings of the prior art, as disclosed in U.S. Pat. No. 3,747,816. The embodiment described here also makes use of adhesive tape supplied in a separate purchasable cassette to facilitate loading new supplies of tape into the apparatus once the old supply of tape is exhausted.

Whereas the present invention is designed to use continuous or discrete pieces of pressure sensitive adhesive tape without backing and having the adhesive on one side, the tape to be dispensed from a cassette or roll, applicant has discovered an enhanced advantage when the tape has jagged or "pinked" edges. Preferably, a continuous tape with jagged or "pinked" edges is used. Applicant has discovered that such a tape, after application as a tab to media, may be torn easily and yet be strong enough for the purpose of maintaining the media sealed during mailing. Further testing has shown that the degree of tearability can be modified by changing the shape of the notches of the jagged or "pinked" edges.

The preferred method of applying the tape to the media comprises the sequential steps of 1) manually inserting the media into the fixture sufficiently to activate a limit switch or other sensor, 2) moving a platen to the underside of the media and in so doing trap substantially one half of a length of tape between the platen and the media, 3) cutting or separating the length of tape from its source, 4) moving an upper roller or sliding member, over the upper, or opposite, planar surface of the media, thus folding the other half of the length of tape over the opposite side of the media and sealing or pressing both sides of the now folded tape to both sides of the media, 5) retracting the upper roller or sliding member and lower platen so that the media may be manually removed, 6) manually removing the media so that the sensor mentioned above is de-activated, and 7) presenting another length of tape into proper position within the apparatus so that the apparatus is ready for insertion of a new set of media. An alternative sequence of steps comprises inserting step 7) between steps 1) and 2). Thus, the length of tape is dispensed into proper position after the media is inserted into the fixture. For a more complete understanding of the present embodiment reference is made to the following detailed description in conjunction with FIGS. 1 through 9 below.

DETAILED DESCRIPTION

Figure 1:
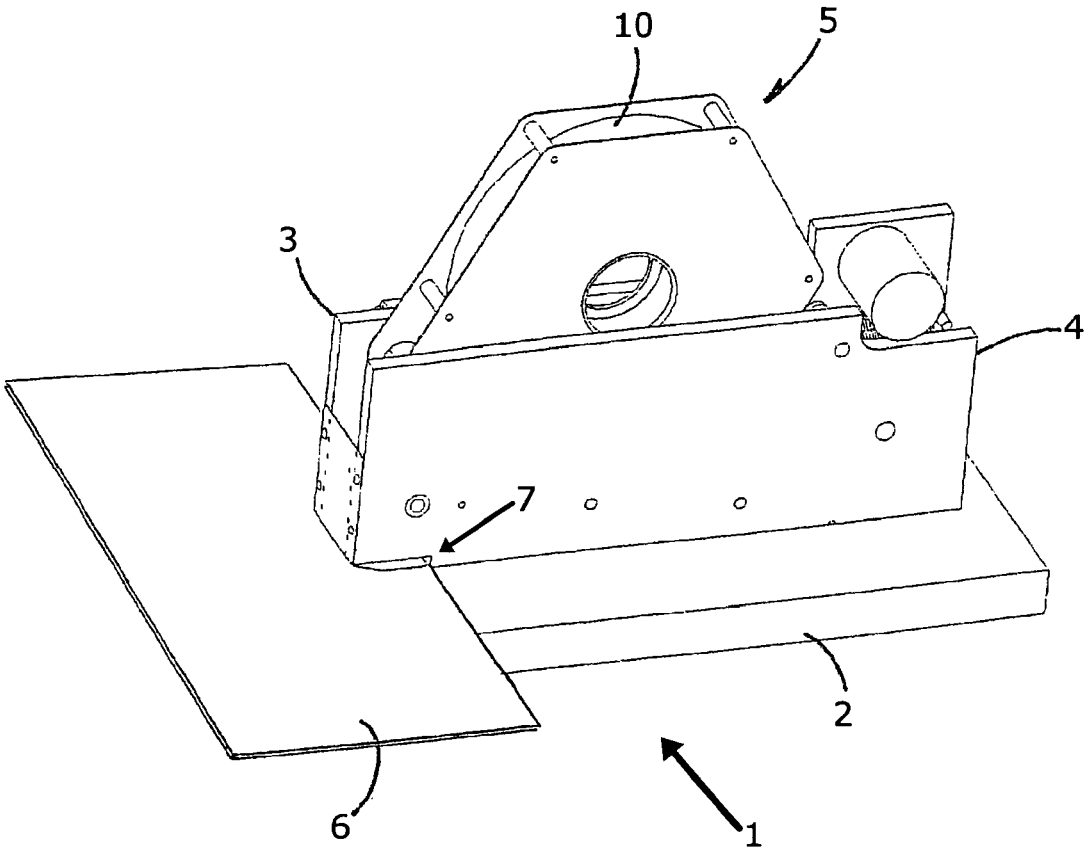
FIG. 1 is an isometric view of the complete apparatus with media inserted for tabbing, but without any cowlings or other coverings that might be used to give the product a styled appearance.

FIG. 1 is an isometric representation of the apparatus generally denoted by 1 according to the present invention. As shown, the apparatus includes a base 2 onto which a tabbing mechanism housed between side walls 3 and 4 is mounted. A cassette generally denoted by 5 containing a roll of adhesive tape 10 is shown inserted between side walls 3 and 4, and a self-mailer 6 (also herein referred to as media) is inserted into a throat 7.

Figure 2:
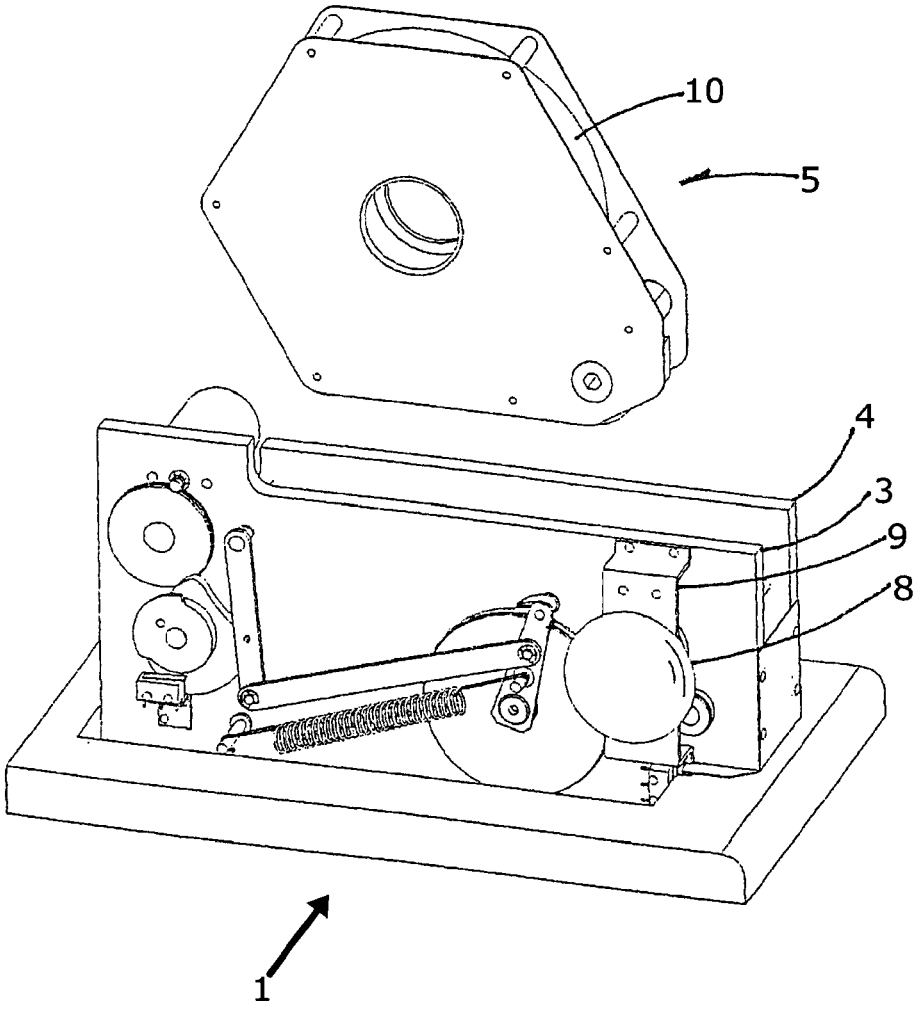
FIG. 2 is the view of the opposite, or left side of the apparatus, with media removed and the tape supply cassette displaced from its nest.

FIG. 2 is a view of the opposite, or left, side of apparatus 1 in which media 6 has been removed, and cassette 5 is displaced from its nest between walls 3 and 4. A rotatable knob 8 is mounted on to a bracket 9 that in turn is fixed to wall 3. Knob 8 will extend outside of any cowling that might be used for styling the apparatus; it is used by the operator to initially advance adhesive tape 10 after insertion of cassette 5. To use the apparatus, an operator inserts the media into the throat and then removes it. Insertion and removal of the media takes place in essentially a single plane with a reciprocating rather than a through-type motion. This action requires only short, simple hand movements and is therefore ideally suited for manual handling of media. Whereas the present figures show the apparatus configured with base 2 in a horizontal plane and employing a removable tape cassette, it can be appreciated that the apparatus could also be adapted for use in other attitudes, with or without removable tape cassette, or added to other equipment that might be suited for this type of loading and unloading of media.

Figure 3:
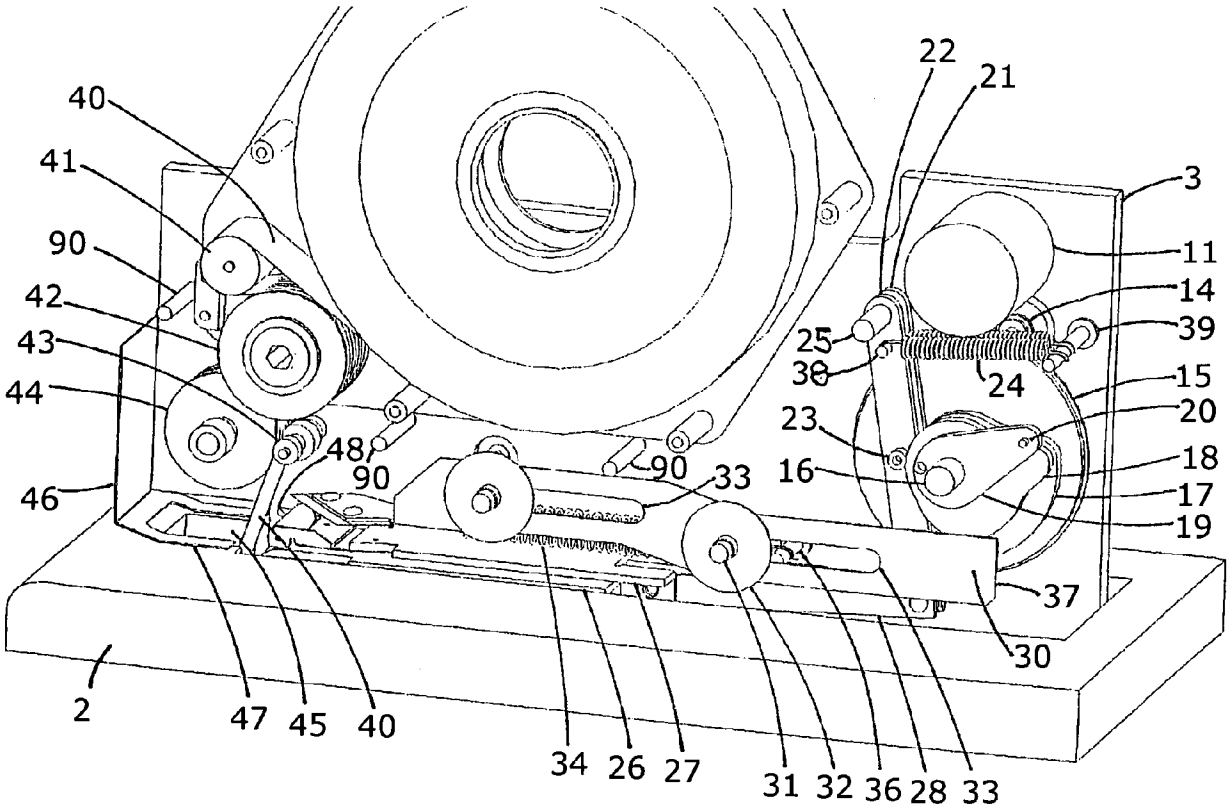
FIG. 3 is an isometric view of the apparatus with the right hand wall removed to show the internal mechanism.

FIG. 3 is a view of the apparatus from the right hand side with side wall 4 and part of the cassette removed to show the internal mechanism. A motor 11 is mounted onto wall 3; the motor shaft speed is reduced through gears 12, 13, (hidden by the wall—see FIG. 6) and 14, and 15. Gear 15 is fixed to a camshaft 16. Also fixed to camshaft 16 are cams 17 and 18 and a pawl 19 having a driving pin 20. Motor 11 is wired so that the rotation of the camshaft and cams is clockwise in FIG. 3. Near the cams a shaft 25 is fixed to walls 3 and 4. Arms 21 and 22 are rotatably mounted to shaft 25 and are fitted with cam followers 23. Extension springs 24 extend between pins 38 (one on each arm) and a stud 39 fixed to wall 3. Arms 21 and 22 thus oscillate to the right and left according to the rotation and profile of cams 17 and 18. Further, arms 21 and 22 are linked to slides 26 and 27 by links 28 and 29 (for 29 see FIG. 5). Slides 26 and 27 are mounted in grooves 48 provided in both side walls 3 and 4 (see also FIG. 5) such that they freely slide to the left and right in FIG. 3. Thus, running of motor 11 will cause a reciprocating action of slides 26 and 27 according to the profile of cams 17 and 18.

FIG. 3 also shows a slide 30 mounted onto side wall 4 (removed for viewing the mechanism) by way of shoulder screws 31. The cylindrical shank of screws 31 fit through slots 33 in the slide. Slide 30, being trapped by the heads of the shoulder screws on one side and washers 32 on the opposite side, maintains its attitude as it moves to the left and right within the limits offered by slots 33. Slide 30 is urged to the right in FIG. 3 by way of extension spring 34, one end of which is attached to a hole 35 in the slide (see FIG. 4*a*), and the other end of which is attached to a pin 36 mounted on wall 3. The right end of slide 30 comprises a cam surface 37 that pin 20 engages during a part of the rotation of pawl 19. Thus, running of motor 11 causes a momentary push to the left of slide 30 as the pawl rotates through a full 360 degrees, and spring 34 returns slide 30 to its original position once pin 20 on pawl 19 clears cam surface 37.

Also shown in FIG. 3 is the course of the adhesive tape through the apparatus. Cassette 5 containing a roll of adhesive tape 10 rests on pins 90 that are fixed to walls 3 and 4. Coming off tape roll 10, a tape band 40 is threaded over a roller 41. Tape band 40 is the fed according to the teachings of U.S. Pat. No. 3,747,816 by rollers 42 and 44, both of which consist of a series of serrated discs, and straightening roller 43 into a more or less straight path into a cavity 45 in base 2. The function of roller 41 is to ensure that a sufficient circumference of roller 42 is covered with tape 40 so that the tape advances without slipping on roller 42 when roller 42 is turned. As explained in the referenced patent, the serrated discs comprising rollers 42 and 44 are geared together (see FIG. 6) in such a way that the surface speed of roller 44 is higher than that of 42 with less circumference in contact with the tape band. Thus the tape band will slip on roll 44 in spite of the adhesive side of the tape being in contact with it. Tape 40 fully separates from roller 44 and is guided into a more or less straight path with the help of roller 43. For further details on the tape feeding action the reader is directed to the referenced patent. It is an object of this embodiment of the invention that the cassette be pre-assembled with tape 40 wound around rollers 41 and 42 and ending on the surface of roller 42. Thus, an advantage of the use of cassette 5 is that the difficult portion of the threading of the tape is already performed for the operator upon purchase of the cassette. This is further described below under the detailed description for FIG. 8.

Also shown in FIG. 3 is a media guide 46 that comprises a spring, approximately L-shaped, having two extensions 47. The vertical portion of media guide 46 is fixed to side walls 3 and 4. Media guide 46 is shaped and mounted so that extensions 47 apply a force onto base 2. Media guide 46 serves to hold media in a more or less flat condition for tabbing.

Figure 4A:
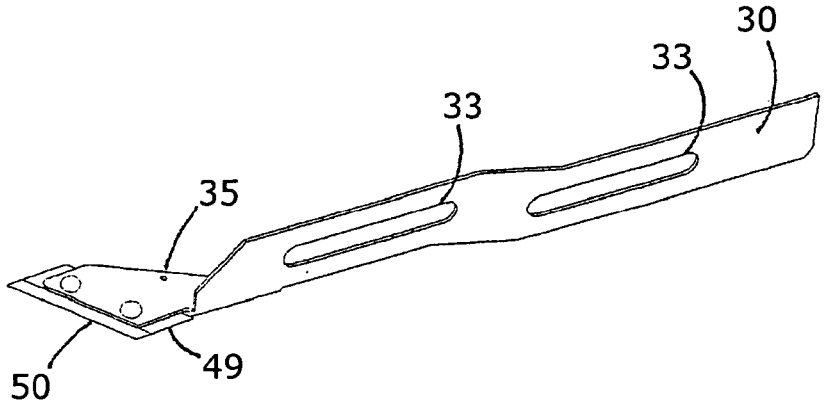
FIGS. 4*a* through 4*c* show the three slides in the mechanism of FIG. 3 that perform the work of cutting and folding the adhesive tape.
Figure 4B:
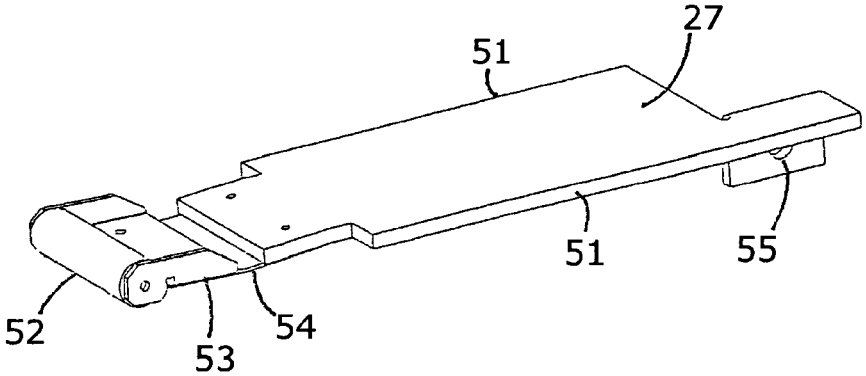
Figure 4C:
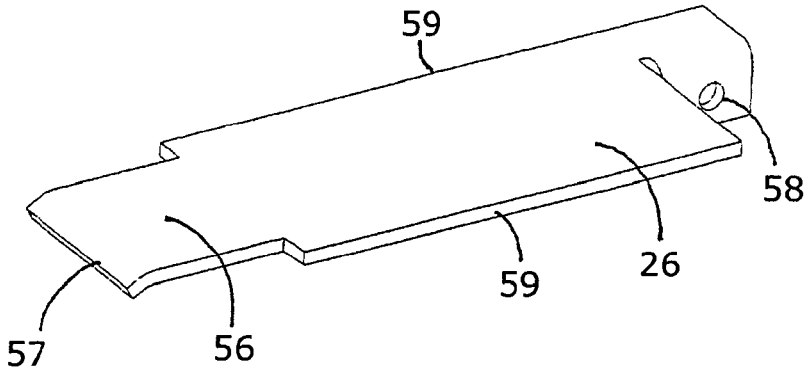

FIGS. 4*a* through 4*c* are isometric representations of slides 26, 27, and 30 referenced above. Slide 30 (FIG. 4*a*) is fitted with a cutting blade 49 attached such that its leading edge 50 lies in a plane substantially parallel to base 2 of the apparatus when the slide is mounted as 6 described in FIG. 3. Leading edge 50 is also angled at approximately 30 degrees to the plane of the adhesive tape. Hence when slide 30 is advanced (to the left in FIG. 3) the tape is cut. The cut progresses from one edge of tape band 40 to the other as slide 30 advances, thus minimizing cutting forces.

Slide 27, shown in FIG. 4*b*, is fitted with a leaf spring 54 and roller 52. Roller 52 is rotatably mounted in a carriage 53. Carriage 53 is fixed to one end of leaf spring 54 and slide 27 is attached to the other end. Leaf spring 54 is shaped so that a constant downward force is exerted by roller 52 onto slide 26 below it. Slide 27 is configured with edges 51 that engage grooves 48 within both side walls 3 and 4. Thus the slide maintains its attitude as it reciprocates from right to left in FIG. 3. One end of the aforementioned link 28 is rotatably fixed to hole 55. The function of the roller, which could also be a sliding surface, is to press the top surface of a piece of adhesive tape downward onto the top of media 6 to be tabbed.

Slide 26, shown in FIG. 4*c*, comprises a substantially planar surface 56, a short, downward-curved leading edge 57, a hole 58 for attachment to its aforementioned driving link 29, and guiding edges 59. Edges 59 engage two of grooves 48 within side walls 3 and 4. Grooves 48 for this slide are located in side walls 3 and 4 such that planar surface 56 is maintained substantially coincident with the plane of base 2 of the apparatus as the slide reciprocates from right to left in FIG. 3. The function of slide 26 is to provide a means for folding substantially half of the dispensed tape band 40 onto the bottom surface of the media to be tabbed and also to provide a platen or bearing surface for the roller 52. Together, the roller 52 and planar surface 56 act as a clamp to seal both halves of the adhesive tape to the media. The downward-curved leading edge 57 ensures that slide 26 does not jam on the media as it travels underneath it.

Figure 5A:
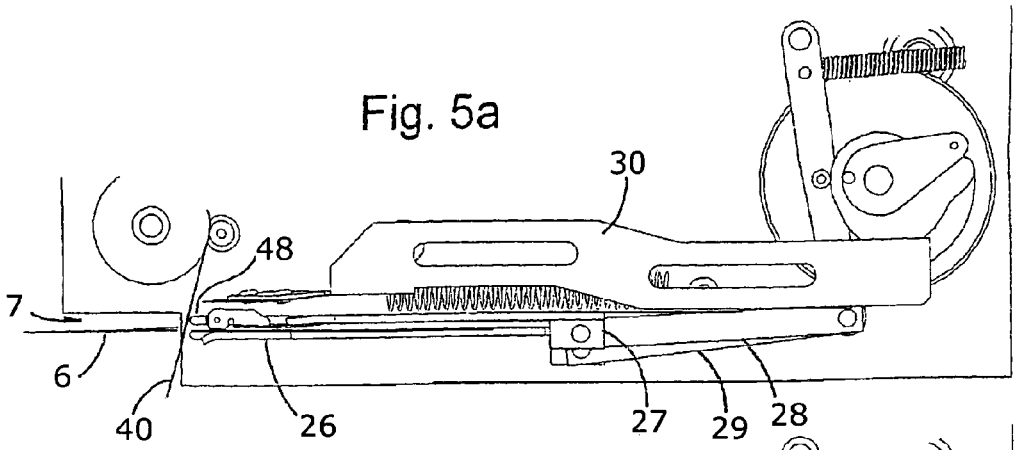
FIGS. 5*a* through 5*f* show the actions of the slides of FIG. 4 and how these actions are effected.
Figure 5B:
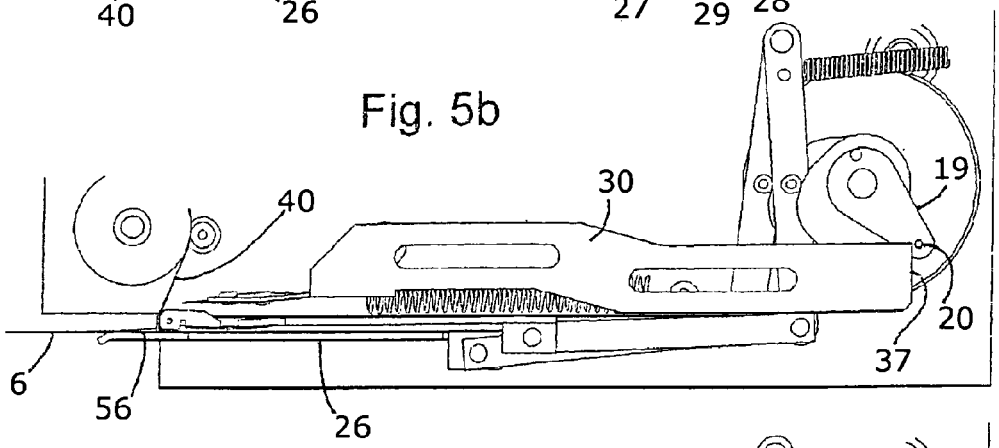
Figure 5C:
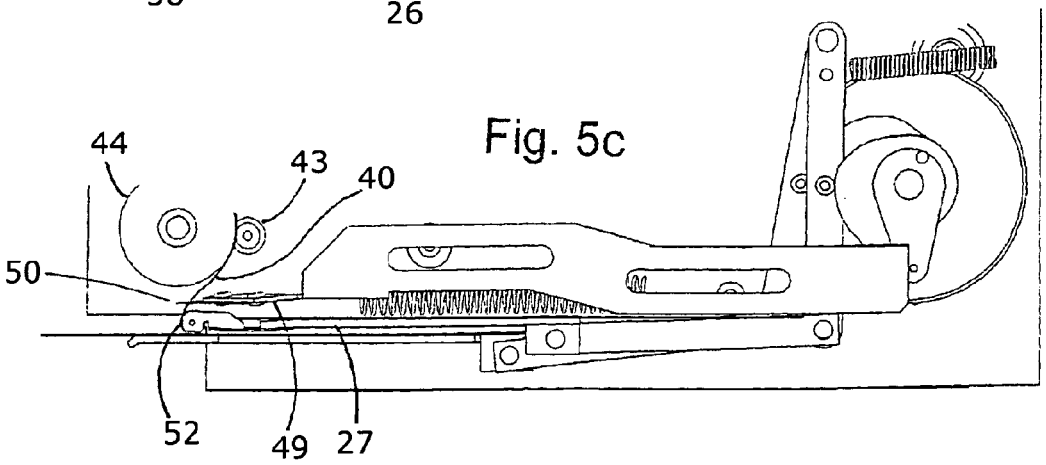
Figure 5D:
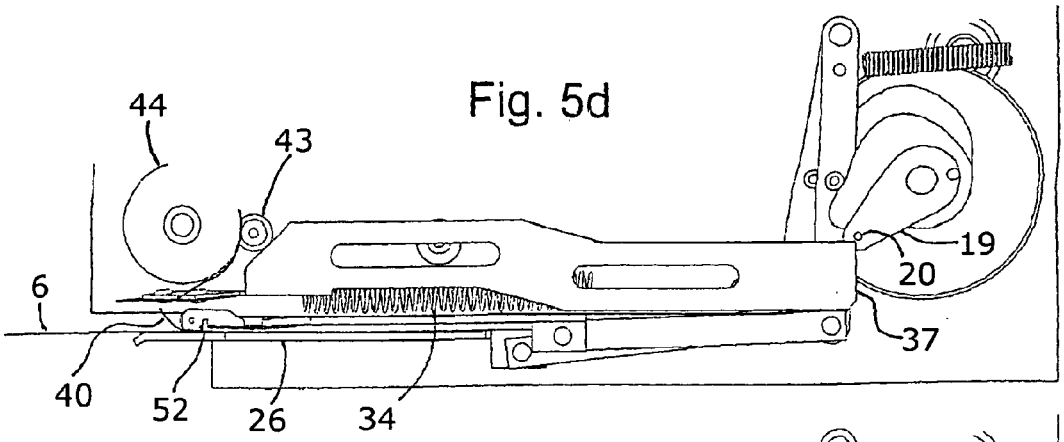
Figure 5E:
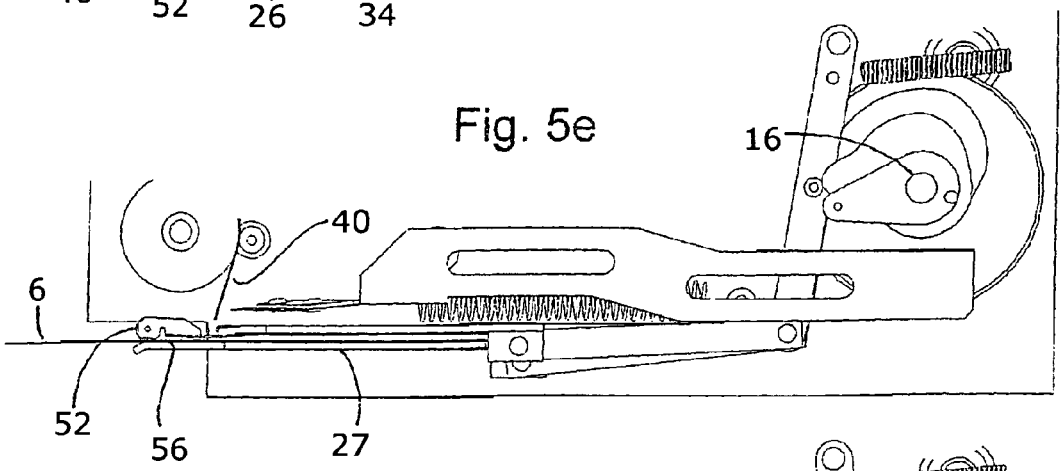
Figure 5F:
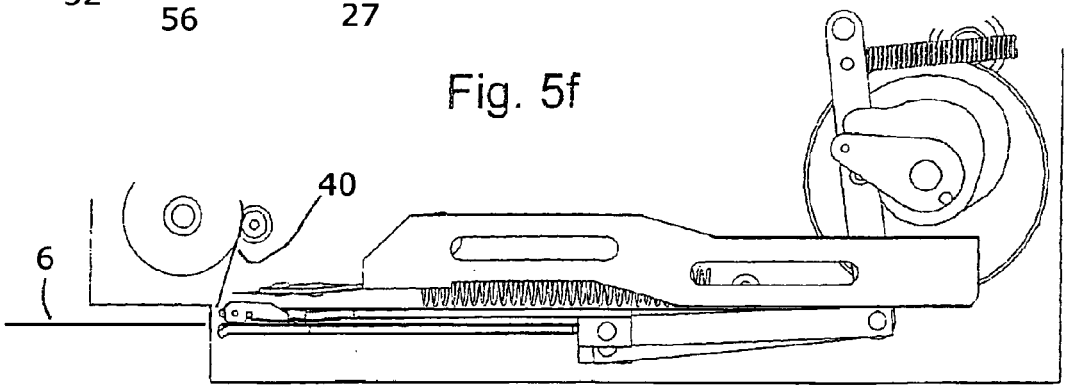

FIGS. 5*a* through 5*f* describe the cutting, folding, and sealing of tape band 40. In each of these figures, slides 26, 27, and 30 are shown along with the actuating members previously described, and adhesive tape band 40 as it is cut, folded and sealed onto the media. In FIG. 5*a* tape band 40 has been dispensed into the position shown, the apparatus is at rest, and media 6 has just been entered into throat 7. Media guide 46 has been removed for clarity. A sensor 60 (FIG. 6), which could be a limit switch or other device, starts motor 11 when media 6 is in position to be tabbed (see also circuit, FIG. 8). In FIG. 5*b* the camshaft is shown rotated to a position wherein planar surface 56 of slide 26 is extended into hole area 45 of base 2, directly under the media. In so doing it has folded the bottom half of dispensed band 40 onto the bottom surface of the media. Also in FIG. 5*b* drive pin 20 on pawl 19 has just contacted cam surface 37 of slide 30. In FIG. 5*c*, with rotation of shaft 16, roller 52 is advanced to a position just on top of media 6 near the leading edge of the media. Additional tape has been dispensed as described below to accommodate this position of roller 52. Cutting edge 50 of the blade is now just entering one edge of tape band 40. In FIG. 5*d* the cutting of the tape band is completed, and drive pin 20 on pawl 19 has just cleared cam surface 37 so that spring 34 may pull slide 30 back to its original position. During cutting, tape 40 is held in place by the pinching action of roller 52 against slide 26 on the one end and the pinching action of rollers 43 and 44 on the other end. In FIG. 5*e* roller 52 has advanced to the end of its stroke and in so doing it seals tape 40 on both sides as it presses the tape and media together over planar surface 56 of slide 26. In FIG. 5*f* the slides have retracted. A second limit switch (described in FIG. 6) stops the motor, and the cams stop turning until after the media is removed. After removal of media, the motor runs until the remaining portion of tape is dispensed, so that the process may repeat.

Figure 6:
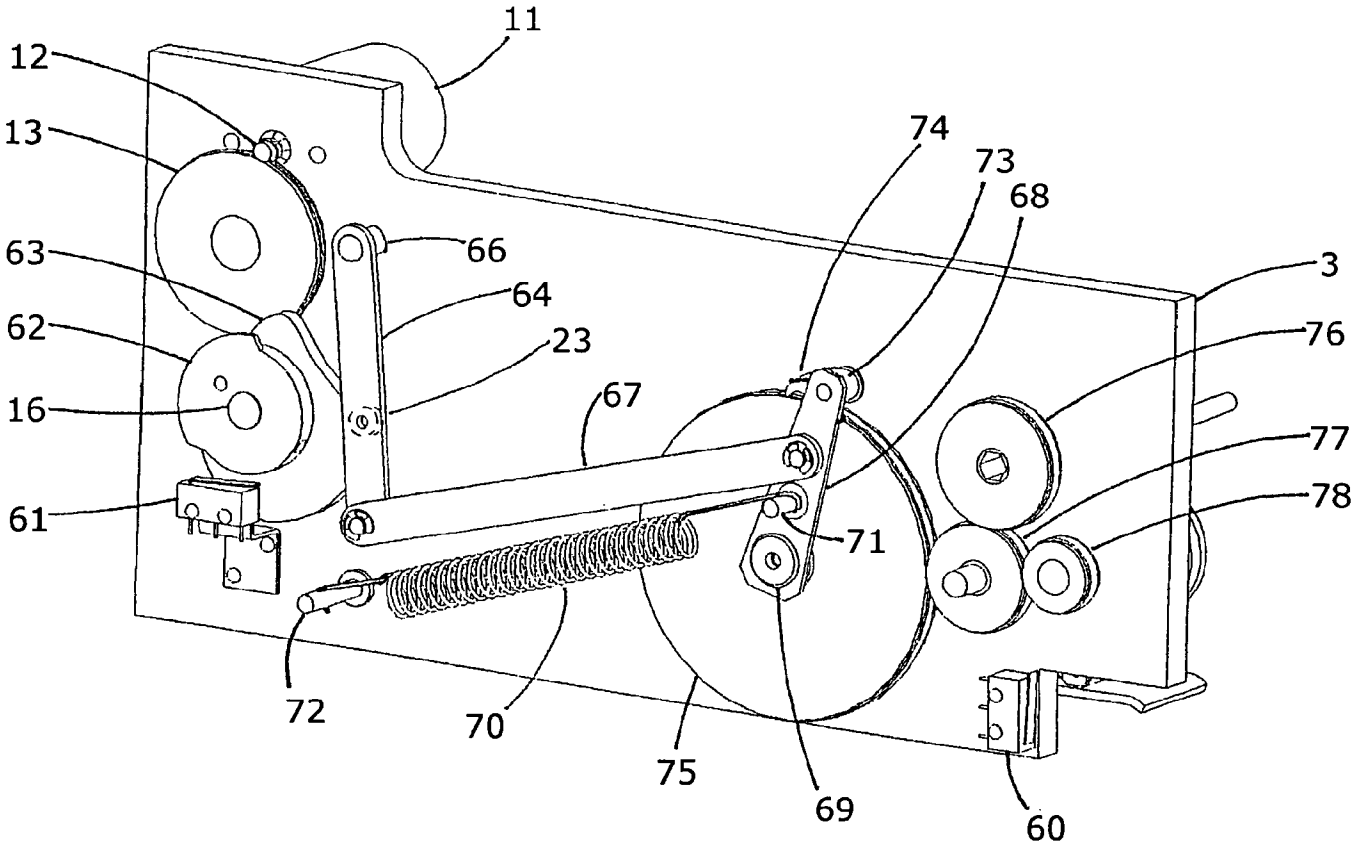
FIG. 6 is a detailed view of the left side of the apparatus showing the adhesive tape drive means.

FIG. 6 shows the actuating mechanism for the dispensing of tape band 40. Here, camshaft 16 is seen from the opposite end shown in FIG. 3 as well as motor 11 and gears 12 and 13 that were hidden from view in FIG. 3. Cams 62 and 63 are fixed to camshaft 16 and rotate as a unit with the other cams described above. An arm 64 with cam follower 23 is mounted at pivot point 66 so that follower 23 may follow the profile of cam 63. At the lower end of arm 64 a link 67 is attached. Link 67 extends to arm 68, which in turn is mounted onto a hub 69 such that it can swivel freely. An extension spring 70 is attached at pin 71 on arm 68 on the one end and on stud 72, which is fixed to wall 3, on the other end and serves to hold the follower in contact with cam 63. Thus, rotation of shaft 16 causes a reciprocating motion of swivel arm 68 according to the profile of cam 63. At the top end of arm 68 a pawl 73 and pawl spring 74 are provided. The pawl engages the periphery of a gear 75. Gear 75 engages gear 77 that in turn drives gears 76 and 78. Gear 77 is mounted on bracket 9 and not on wall 3, but is shown here in its correct position with bracket 9 removed for clarity. Gear 75 also acts as a ratchet and turns only counter-clockwise in this view according to the reciprocating motion of arm 68. Gears 76 and 78 operate the tape dispensing rollers 42 and 44 shown in FIG. 3. The lengths of the various links, the gear ratios, and the profile of cam 63 are chosen so that the desired lengths of tape 40 are dispensed during a full cycle, or 360 degrees rotation of shaft 16, as required to satisfy the folding, cutting and sealing sequence described above: Limit switch 61 is mounted on wall 3 so that it can be actuated by cam 62. Cam 62 has its profile configured such that when the apparatus is in the state described in FIG. 5*f* limit switch 61 is actuated causing motor 11 to stop. The motor starts again to complete the 360 degrees rotation of shaft 16 when the switch or sensor 60 detects that the media has been removed. The profile of cam 63 is chosen such that most of the dispensing of tape band 40 occurs after media 6 is removed; that is, between the stage described in FIG. 5*f* when the media is to be removed and the stage described in FIG. 5*a* when new media has just been inserted.

In an alternative embodiment, the sequence of steps 5*a*-5*f* is modified to dispense tape band 40 just after media 6 is inserted, but before planar surface 56 of slide 26 is extended.

Figure 7:
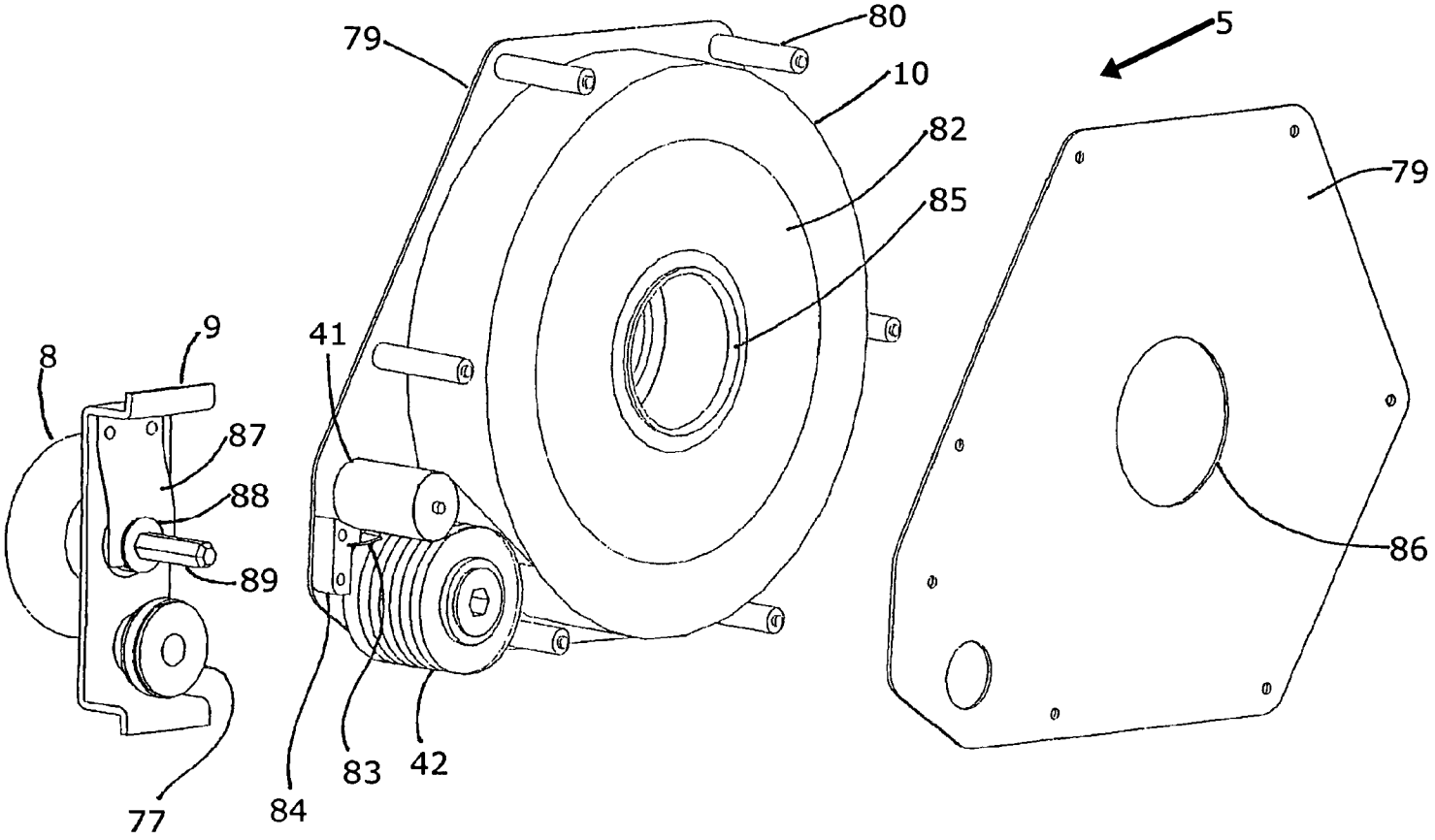
FIG. 7 shows details of the adhesive tape cassette and how it is linked to the apparatus.

FIG. 7 shows the details of tape storage cassette 5 and how it is linked to the rest of the apparatus. Cassette 5 is comprised of two side plates 79, spacing studs 80, a roll of adhesive tape 10, two tape-roll hubs or plates 82, rollers 41 and 42, and a ratchet spring 83 mounted onto a boss 84. The roll of adhesive tape 10 is trapped by its two hubs 82, which in turn ride in holes 86 of side plates 79 by way of their rims 85. Thus, when side plates 79 are attached to their spacer studs 80, the roll of adhesive tape is constrained between side plates 79, but can rotate freely. Tape band 40 is shown threaded over roller 41 and partially over roller 42. Ratchet spring 83 contacts the surface of one of the serrated discs comprising roller 42 and serves to prevent an unwinding of tape 40 within the cassette. Roller 42 is fitted with a hexagonal hole in its center.

Knob 8 is mounted in bracket 9 so that it can turn freely and also so that it can travel axially. A leaf spring 87 is also attached to bracket 9 and fits on its free end to a grooved hub 88 of knob 8. The action of the leaf spring is to urge the knob axially to the right in FIG. 7. Travel of the knob to the right is limited by the underside surface of the knob; travel in the opposite direction is limited by the flat surface of the leaf spring coming into contact with bracket 9. Within this range of axial travel hexagonal shaft 89 is always engaged within the hexagonal hole of gear 77 (FIG. 6). When assembled and when knob 8 is urged to the right, hexagonal shaft 89 of knob 8 also engages the hexagonal hole of roller 42. Thus, it is possible for an operator to advance the tape manually by a turning of knob 8. Removal of cassette 5 is effected by pulling knob 8 to the left and lifting the cassette out of the apparatus. When placing a new cassette into the apparatus, the operator lowers the cassette onto its nesting pins 90 (FIG. 3) while holding the knob to the left. Releasing the knob then allows shaft 89 to re-engage driving roller 42.

Figure 8:
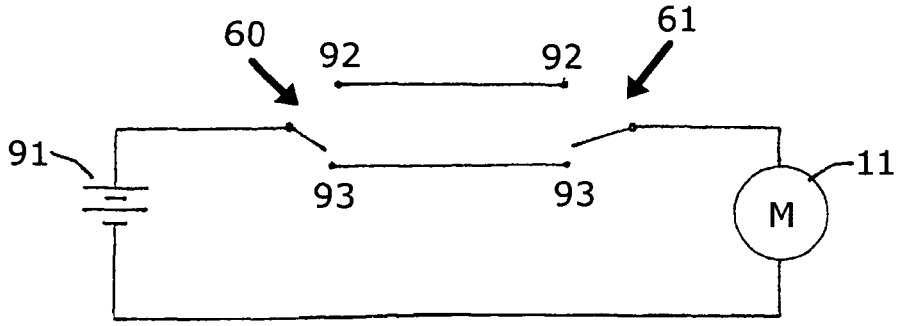
FIG. 8 is a circuit showing how the drive motor is turned on and off.

FIG. 8 shows an electric circuit. A power source 91, which in some embodiments is a battery, is connected to a motor 11 by way of two switches 60 and 61 that are shown to be coupled in series. These switches correspond to the switches shown in FIG. 6 above. The motor runs as long as both switches are in contact either at terminals 92 or 93.

Figure 9:
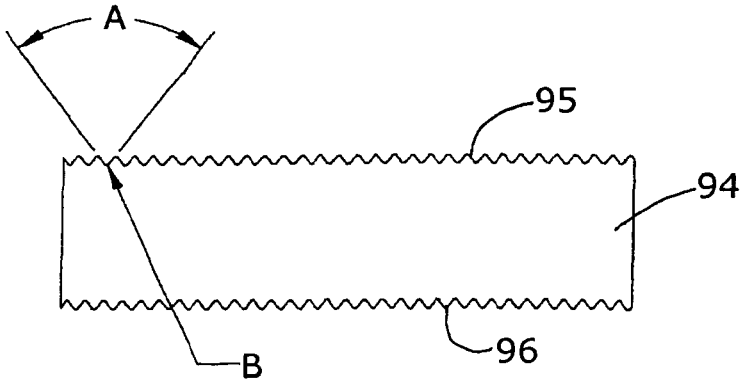
FIG. 9 is a length of the continuous tape showing "pinking" of the edges.

FIG. 9 illustrates a length of continuous adhesive tape 94 with "pinking" on both edges 95 and 96, and adhesive disposed on one of its sides. Surprisingly, applicant has discovered that after application to media, the tab or length of adhesive tape 94 retains its strength through mailing and handling, but upon insertion of a finger in the media, the tab or adhesive tape tears more easily along the crease or fold of the tab or adhesive tape. Testing has shown that the degree of tearability can be modified by changing the shape of the notches forming the "pinking." For example, angle A of the sides of the notches or the size of the radius B at the inside corner of the notches can be modified or selected to fit adhesive tapes of various strengths.

Although the invention has been described in terms of specific embodiments and applications, persons skilled in the art can, in light of this teaching, generate additional embodiments without exceeding the scope or departing from the spirit of the claimed invention. Accordingly, it is to be understood that the drawing and description in this disclosure are proffered to facilitate comprehension of the invention, and should not be construed to limit the scope thereof.

What is claimed is:

1. A tabber for tabbing media having upper and lower surfaces, the tabber comprising:

an apparatus including a fixture for accepting media to be tabbed wherein the media is inserted with its free edges oriented as the leading edge of the media along a first direction of a planar path, tabbed to secure the free edges of the media together, and retracted along a second direction of essentially the same planar path as the insertion path, the first and second directions being substantially opposite to one another;

an actuator for projecting a length of pressure-sensitive adhesive tape of the type without backing and having adhesive only on one side into a planar position substantially perpendicular to the planar path of the media, said length of pressure-sensitive adhesive tape including a first portion having a free, unsupported end lying beneath the lower surface of the inserted media and a second portion held by said actuator above the plane of the upper surface of the inserted media with the side of said tape containing the adhesive facing the free edges of the media;

a first device for fixing the first portion and free end of the pressure-sensitive adhesive tape to the lower surface of the media, said first device for fixing the first portion including a first actuatable platen extendable through the planar position of the pressure-sensitive adhesive tape and along the lower surface of the media in the second direction of the planar path to contact and affix the first portion of the pressure-sensitive adhesive tape to the lower surface of the media;

cutting apparatus movable for cutting the pressure-sensitive adhesive tape at a location spaced above the upper surface of the media to thereby sever the second portion of the tape free from said actuator, said cutting apparatus being actuatable for cutting subsequent to actuation of said first device and in a direction transverse to the planar position of the pressure-sensitive adhesive tape; and a second device for fixing the cut second portion of the pressure-sensitive adhesive tape onto the upper surface of the media, said second device including a second actuatable platen extendable in the second direction of the planar path in a complete fixing stroke through the planar position of the pressure-sensitive adhesive tape and along the upper surface of the media to contact and affix the second portion of the pressure-sensitive adhesive tape to the upper surface of the media thereby folding the second and first portions of the pressure-sensitive adhesive tape, respectively, over the upper and lower surfaces of the media and thereby firmly sealing the adhesive tape to the upper and lower surfaces of the media, said second device also including a movable roller carried on a leading end of the second platen and wherein said roller initially in the fixing stroke performs in cooperation with the first platen a pinching action on one end of the second portion of the tape to hold the tape stationary while said actuator holds the other end of the second portion of the tape stationary while said cutting apparatus is moved for cutting the tape; and a sensor for sensing full insertion of media and actuating the tabbing of the media.

2. The tabber of claim 1 wherein said cutting apparatus comprises a knife movable for cutting the pressure-sensitive adhesive tape transversely beginning at one edge and continuing to an opposite edge of the pressure-sensitive adhesive tape.

3. The tabber of claim 1 wherein there is further provided a further sensor for sensing full projection of the length of the pressure-sensitive adhesive tape and for halting further projection of the pressure-sensitive adhesive tape.

4. The tabber of claim 1 wherein there is further provided a continuous roll of the pressure-sensitive adhesive tape for supplying the length of pressure-sensitive adhesive tape to said actuator for projecting a length of the pressure-sensitive adhesive tape.

* * * * *